United States Patent [19]

Kessler

[11] 4,402,639

[45] Sep. 6, 1983

[54] ANCHOR BOLT

[75] Inventor: Jürgen Kessler, Stuttgart, Fed. Rep. of Germany

[73] Assignee: Hilti Aktiengesellschaft, Schaan, Liechtenstein

[21] Appl. No.: 242,915

[22] Filed: Mar. 12, 1981

[30] Foreign Application Priority Data

Mar. 19, 1980 [DE] Fed. Rep. of Germany ..... 3010440

[51] Int. Cl.[3] ..... F16B 13/04

[52] U.S. Cl. ..... 411/51; 411/65

[58] Field of Search ..... 411/49, 50, 51, 52, 411/53, 55, 63, 64, 65, 66

[56] References Cited

U.S. PATENT DOCUMENTS

| | | | |
|---|---|---|---|
| 282,501 | 8/1883 | Cornell | 411/65 |
| 831,464 | 9/1906 | O'Leary | 411/53 |
| 1,795,057 | 3/1931 | Tomkinson | 411/53 |
| 2,642,768 | 6/1953 | Ogburn | 411/53 |
| 3,524,379 | 8/1970 | Fischer | 411/49 |
| 3,884,099 | 5/1975 | Sikstrom | 411/51 |
| 4,112,814 | 9/1978 | Schafers | 411/52 |

FOREIGN PATENT DOCUMENTS

| | | | |
|---|---|---|---|
| 1069993 | 2/1954 | France | 411/51 |
| 1517357 | 2/1968 | France | 411/55 |
| 904899 | 9/1962 | United Kingdom | 411/53 |
| 1353559 | 5/1974 | United Kingdom | 411/51 |

*Primary Examiner*—Thomas J. Holko

*Attorney, Agent, or Firm*—Toren, McGeady and Stanger

[57] ABSTRACT

An anchor bolt is arranged to be secured in a relatively deeply drilled hole having a conical enlargement adjacent the base or inner end of the hole. The anchor bolt is formed of an axially elongated tie rod and an anchor located on the end of the tie rod which is inserted into the base of the drilled hole. The anchor is made up of a number of radially expandable sleeve segments. The anchor also includes a cone element for expanding the sleeve segments radially outwardly into the conical enlargement in the hole. The sleeve segments have an outside radius variable in the axial direction of the segments. The radially outer surface of the segments is substantially smooth for their axial length. At the smaller diameter end of the sleeve, the segments are held together by an annular elastic disc. The radial outer periphery of the disc projects at least partly beyond the diameter of the smaller diameter end of the sleeve and is arranged to have a larger diameter than the smaller diameter end of the conical enlargement in the hole.

10 Claims, 5 Drawing Figures

ANCHOR BOLT

This invention relates to an anchor bolt or peg suitable for use in a relatively deep drilled hole, in soft material, such as a coal seam, and which hole, at its base is provided with a conical enlargement.

With a known anchor bolt or peg of this type, as has become known, for example, from German Patent Disclosure 23 31 467, the expandible segments are made in one piece with a broad cylindrical ring and by machining elongated slots into a cylindrical blank, which means that they have the same outside radius over this entire length. A disadvantage of the above is on the one hand, the relatively rigid connection and, consequently the difficult movability of the segments in relation to one another and to the cylindrical ring, and on the other hand, the fact that the segments, because of their identical radius, in the larger diameter area of the conical enlargement, are not in form-locking contact with the inside wall of the conical enlargement over the entire surface, but only over a more or less wide surface line. In the case of soft materials this has disadvantages in so far as that a higher surface pressure occurs there, which may destroy the inside wall. Furthermore, because of the relatively rigid connection of the segments between each other, the obtainable cone angle is limited with regard to its size. Furthermore, with this known anchor bolt it is not always ensured that, during the tightening of the fastening screw, and, therefore, of the cone element prior to expansion of the sleeve segments, it does not move out of the conical enlargement of the drilled hole, or that the sleeve turns along, seeing that it does not find an abutment in the axial and/or radial direction. Furthermore, the cylindrical ring is so wide that it extends from the enlargement in the drilled hole to the beginning of the hole, so as to serve as a support during tightening of the fastening element. This construction is, therefore, suitable only for normal fastening arrangements, with which the hole depth amounts only to a few cm.

The objective of the present invention is, therefore, to provide an anchor bolt or peg which is suitable for use in soft material, such as for example coal seams, and which is suitable for great drill hole depths, with which, therefore, in particular, a relatively steep cone, a maximum form-locking condition over the entire outer periphery and a secure seating at great depths, are achieved.

According to the invention there is provided an anchor bolt suitable for use in a relatively deep drilled hole having a conical enlargement near its base, the bolt comprising a shank, or fastening element, and an anchor which includes a sleeve having radially expandable segments which are held together at one end and a cone element for expanding the sleeve segments, characterized in that the segments of the sleeve have over their length an outside radius which changes in accordance with the conical enlargement and in that their outer periphery is substantially smooth, in that at their one end they are held together by means of an elastic disc, the outer periphery of which projects at least partially beyond the periphery of the smaller diameter inside wall zone of the conical enlargement.

With the anchor bolt according to the invention the expandable segments are accurately adapted to the conical shape of the drill hole enlargement, so that in the expanded state they are over their entire outer periphery in form-locking contact with the inside wall of the conical enlargement. In this manner an uneven surface pressure is avoided, which otherwise could destroy the coal seam in this zone, which again would have an adverse effect on the form-locking between the anchor and the drill hole enlargement. In other words, the coal seam in the vicinity of the anchor is not destroyed. This, in the same manner, also ensures that the sleeve segments are smooth on the outer periphery side, so that also as a result thereof no differences in the surface pressure or a cutting-in into the inside wall can occur. Furthermore, the elastic disc achieves that during the tightening of the core element the sleeve stays in the drill hole or drill hole enlargement, but that it can nevertheless be put into the drill hole in a simple and unobstructed manner. This can, on the one hand, be attributed to the elastic design of the disc, and, on the other hand, to the fact that at its rear end in the feed direction, it is substantially free, whereas on its other side it rests against the relatively large diameter face of the segments. In this manner, when inserting the anchor the disc can lie back, whereas during movement opposite to the direction of feed it stands up and claws into the layer of coal. This ensures not only axial securing, but also protection against turning of the sleeve during tightening of the threaded fastening elements or the cone element. Furthermore, due to the elastic disc, relatively simple and easy expansion of the sleeve segments is achieved, which also readily permits a cone with a relatively large angle.

In a preferred exemplified embodiment of the present invention, the shank or fastening element is a long tie rod, which at its end projecting into the drilled hole has an axial stop ensuring the setting depth of the sleeve, it is ensured that the corresponding setting depth of the sleeve after the insertion of the anchor belt into the hole, is reached.

According to a preferred exemplified embodiment of the invention, the segments of the sleeve and/or the cone element, in order to facilitate the production, are made of cast iron, i.e. malleable cast iron. In this case the segments also result in a saving in material, seeing that projecting from the inner periphery they have only a relatively short guide surface for the cone element to be pulled in. To achieve protection against turning between the cone element and the sleeve in a simple manner, at least one, but preferably all the segments of the sleeve have on their projecting guide surface a groove extending in the lengthwise direction, and the cone element has in at least one zone of the outer periphery a correspondingly extending projecting web, which during the tightening of the fastening element can engage with the groove of the adjacent segment.

Further details and embodiments of the invention can be noted from the following description, in which the invention is described and explained in greater detail, with reference to the exemplified embodiments illustrated in the drawings, in which.

Figure 1:
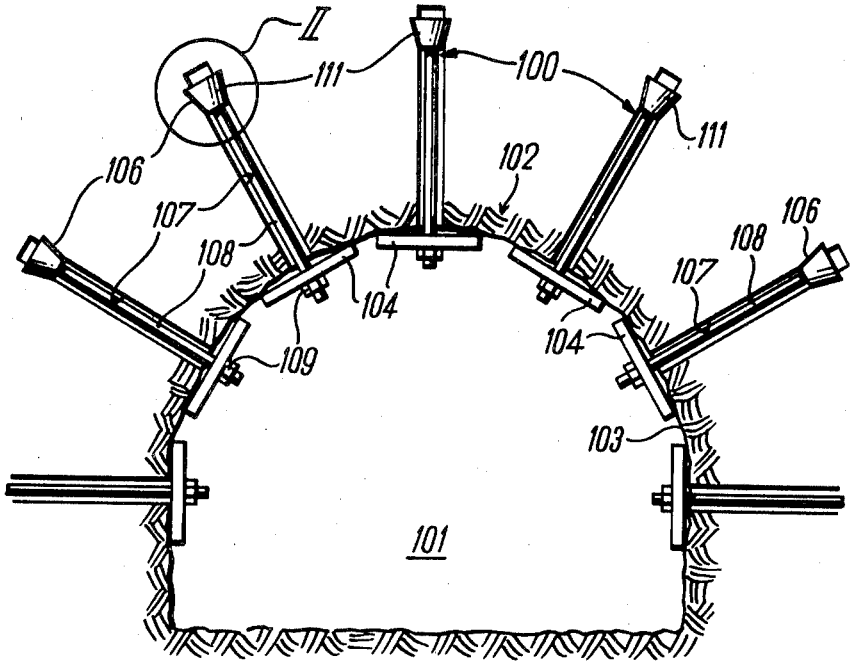
FIG. 1 is a diagrammatic representation of a section through a tunnel in a coal seam, so as to illustrate the field of application of the present invention, and so as to illustrate an anchor bolt according to the present invention inserted into a drilled hole.

FIG. 1 illustrates, diagrammatically, the preferable field of application or the preferable range of application of the anchor bolt 100 according to the invention, which comprises an anchor 111 and a fastening element in the form of a tie rod 108. In underground coal mines, tunnels 101 are driven into coal seams 102, the inside walls 103 of which must be secured. This takes place by means of the production of deep drill holes 107 which at a setting depth of about 1,2 to 1,8 m or more are provided with a conical enlargement 106, and into which an anchor bolt 100, with the anchor 111 in a non-expanded position is inserted. The anchor 111 is then expanded by turning or tightening the tie rod 108, and is thus placed in a form-locking relationship with the conical drill hole enlargement 106. The end of the tie rod 108 projecting out of the hole 107 in the coal seam 102 is braced against the inside wall area 103 by a short beam or a steel plate 104 by means of a nut 109 or similar fastening element. In this manner, with the anchor bolt 100 according to the invention, a self-carrying support and securing of the inside wall 103 of the tunnel 101 in question is obtained. As mentioned above, these fastening drill holes 107 are about 1,20 to 1,80 m long, i.e. at this depth the anchor 111 is placed in the relatively soft coal seam. These fastenings are provided about every meter in the direction of the width as well as in the direction of the length of the tunnel 101. The fastened beam pieces or plates 104 may be of different sizes, e.g. 1,2 m square.

With reference to FIGS. 2 to 5, in the following, an anchor bolt 100 according to a preferred exemplified embodiment of the present invention will be described in detail. The anchor 111 of the anchor bolt 100 consists basically of a sleeve 112 and a conical expansion element 113, which by means of an internal thread 114 can be screwed onto the threaded end 116 of the tie rod 108, which end first enters the drill hole, and which expands the sleeve 112.

The sleeve 112 consists basically of a number of segments 117, in the case of the exemplified embodiment of four segments 117, which over their length have a changing outside radius. In other words, the segments 117 have, seen over their length, an outside radius which changes constantly in accordance with the radius of the conical drill hole enlargement 106. The segments 107 must, therefore, be regarded as parts or pieces of a hollow cone which fits exactly into the conical drill hole enlargement 106, which pieces are cut out from this hollow cone between two parallel longitudinal surface lines, resulting in wedge-shaped scrap parts, as can be noted in particular from the view of the expanded sleeve segments of FIG. 5. However, the segments 117 preferably are not made as described above, but in order to facilitate the production, they can cast individually, e.g. from malleable cast iron. The outer surface 118 of the segments 117 is basically made completely smooth.

To the end of each segment 117, which in the expanded position has the smallest diameter, a part of a collar 119 is formed on, which has a considerably smaller outside diameter than the adjacent opposite face 121 on the segment 117, and between which and the opposite face 121 of the joined segments 117 a groove 122 is machined in. In this groove 122 an annular elastic disc 123 is positioned, which on the inner periphery has an opening 124, which in this manner holds the four segments 117 together and this in such a manner that on the one hand they do not fall apart, and on the other hand they can with their opposite end be moved in a radial direction, i.e. the sleeve 112 as a whole can be expanded. As can be noted from the view of FIG. 4, the elastic disc 123 has a square outer periphery, the length of the sides of this square being slightly smaller than the diameter of the face 121 of the sleeve 112, but the diagonal of the square being greater than the diameter of this face 121, and therefore also greater than the diameter of the drill hole 107. The walls of the segments 117 are relatively thin, except for a guide surface 126 provided in the rear third and projecting radially inwards, which in the axial direction is relatively small and which on every segment 117 is provided with a groove 127 with a preferably semi-circular cross-section and extending lengthwise. In the longitudinal range of the guide surfaces 126 the segments 117 are provided over the outer periphery with machined-in flutes 128, in which is inserted a resiliently prestressed element, e.g. in the form of a spring ring 129, a rubber band or the like. This spring ring 129 because of its radial spring force brings the segments 117 of the sleeve 112 into the neutral position illustrated in FIG. 3, in which the outside diameter of the pressed together sleeve segments 117 is smaller than the inside diameter of the drill hole 107.

In this position the smallest inside diameter of the sleeve 112 formed by the guide surfaces 126 is slightly greater or just as great as the outside diameter of the threaded end 116 of the rod 108, which is pushed through the central opening of the collar 119 into the sleeve 112. Seeing that the sleeve 112 is pushed loose onto the end 116 of the tie rod 108, same is provided with a stop ring 131, against which the sleeve 112 can rest during the insertion into the drill hole 107, so that the adherence to the setting depth in question is ensured.

Figure 2:
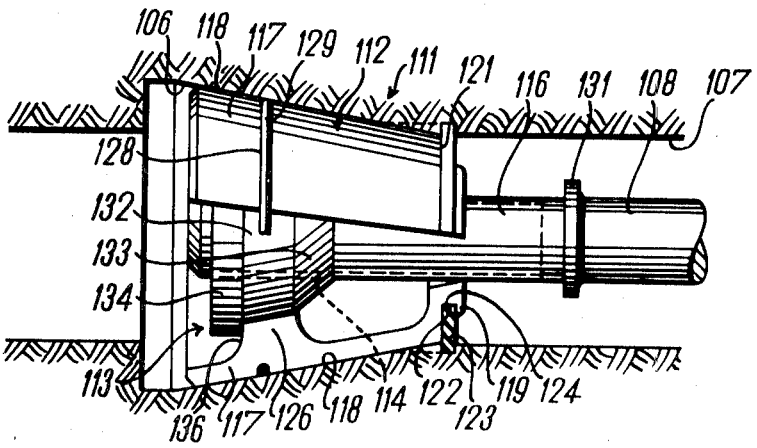
FIG. 2 is an enlarged representation of the circled part II of FIG. 1 showing an expanded anchor of the anchor bolt according to the invention inserted in a conical enlargement in a drill hole.
Figure 3:
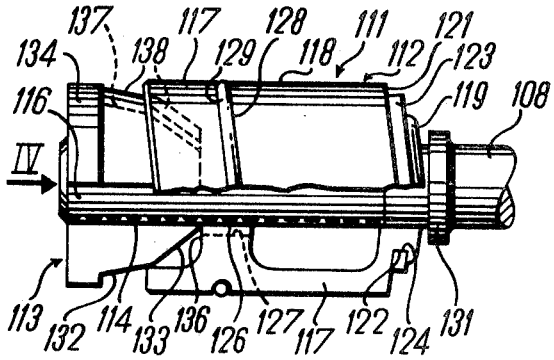
FIG. 3 shows the anchor of FIG. 2 in its position prior to expansion, i.e. in a position in which it can be inserted into a drilled hole by means of a fastening element, but turned through 45° compared to FIG. 2.
Figure 4:
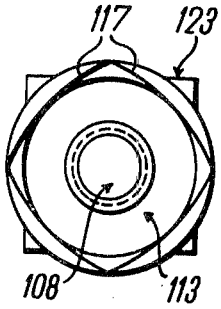
FIG. 4 is a view of the anchor in its initial position according to the arrow IV of FIG. 3.
Figure 5:
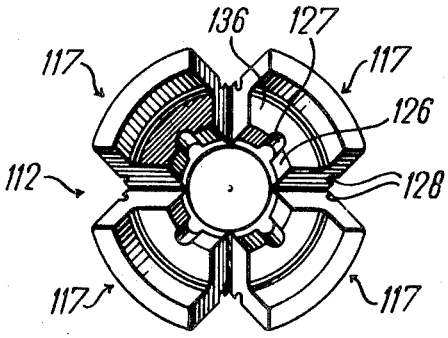
FIG. 5 is a front view of the expanded sleeve of the anchor bolt.

The cone element or the expansion cone 113 has a main cone surface 132 and a steeper conical lead-in surface 133 forming the front end of the expansion element 113, and a stop collar 134 forming the rear end of the expansion element 113, which, as shown in FIG. 2, in the expanded position of the sleeve 112 butts against the rear face 136 of the guide surface projection 126 of the sleeve 112, and as a result cannot slip through same.

At one point of the outer periphery of the expansion element 113 a groove 137 is provided with a preferably semi-circular cross-section and extending in the lengthwise direction over both the conical surfaces 133 and 132, into which groove one round rod 138 or two round rods 138 placed behind one another are inserted, and fastened, for example, by welding. It is also possible to produce the expansion element as a cast iron part, and thus to cast on the projections 138. As a result thereof the round rods or projections 138 project with half their diameter from the groove 137, and during the drawing-in of the expansion element engage in the sleeve 112 in one of the grooves 127 of one of the guide surfaces 126. This ensures that no turning takes place between the sleeve 112 and the straddling element 112. This protection against turning is either ensured already during the preassembling of the anchor 111 on the rod 108 (see FIG. 3), or it comes into effect when the rod 108 is tightened, when at first the expansion element 113 moves along until the front round rod 138 comes in the lead-in cone 133 in line with a guide surface groove 127 in one of the segments 117 of the sleeve 112, and engages with this groove. When tightening the rod 108 further, the segments 117 are expanded completely, the guide surfaces 126 first sliding on the front lead-in surface 133 and then over the main cone surface 132 of the expansion element 113. The final position is shown in FIG. 2, from which it can be noted that in this expanded position, in which the anchor 111 lies exactly form-locking in the drill hole enlargement 106, the guide surfaces 126 of the segments 117 lie parallel to the main cone surface 132.

The collar 134 lies against the stop face 136, so that it is impossible for the expansion element to be pulled through the sleeve 112. The turning protection of the sleeve 112 in relation to the fastening rod 108 and the movement protection in the axial direction in relation to the threaded rod 108 during the tightening, is achieved by the elastic disc 123, which during introduction of the anchor 111 into the drill hole 107, because of its elasticity and because of the fact that the periphery of the collar 119 is considerably smaller, can bend backwards against the direction of feed. When the rod 108 has been pushed in so far that the anchor 111 lies in the area of the conical drill hole enlargement 106, which can be noted for example from a front marking on the fastening rod 108, and as a result the anchor 111 is again pulled slightly in the opposite direction, the elastic disc 123 rights itself again at the corners and clamps or cuts into the wall of the conical drill hole enlargement 106, so that movement in the axial as well as in the peripheral direction is prevented, seeing that the elastic disc 123 cannot bend back because of the large-diameter face 121 of the sleeve 112 against which it rests. Furthermore, during this pulling-back movement of the rod 108, the sleeve segments 117 are expanded immediately. This considerably facilitates the handling, seeing that no screw is required for the expansion of the anchor 111. The pulling back of the rod 108 causes a self-holding of the anchor 111 and of the rod 108 in the drill hole.

I claim:

1. An anchor bolt suitable for use in a relatively deep drilled hole having a conical enlargement near its base, said bolt comprising an elongated shank, and an anchor which includes a sleeve having radially expandable segments which are held together at one end of said sleeve and a cone element for radially expanding the sleeve segments, characterized in that the segments (117) of the sleeve (112) have over their length extending in the elongated direction of said shank an outside radius which changes in accordance with the conical enlargement (106), each said segment having a substantially smooth radially outer periphery for the length thereof, an annular elastic disc (123) encircling the smaller radius ends of said sleeve segments and securing said sleeve segments together, said elastic disk having a radially outer periphery projecting at least partially beyond the radial periphery of the smaller diameter end of said sleeve and adapted to have a maximum radial diameter greater than the smaller diameter end of the conical enlargement formed in the deep drilled hole.

2. An anchor bolt, according to claim 1, characterized in that said shank is a tie rod (108), which adjacent its end projecting into the drilled hole (107) has an axial stop (131) extending radially outwardly from and at least partly encircling said tie rod for ensuring the setting depth of the sleeve (112).

3. An anchor bolt, according to claim 1, characterized in that the segments (117) are made of cast iron in the manner of pieces cut out along a longitudinal surface line from a hollow cone dimensioned to fit into the conical enlargement (106) in the deep drilled hole.

4. An anchor bolt, according to claim 1 or claim 3 characterized in that said sleeve formed by said sleeve segments has a collar at the smaller diameter end thereof with said collar (119) extending axially outwardly from the end face of said smaller diameter end of said sleeve and stepped radially inwardly from the radially outer periphery of the smaller diameter end of said sleeve, said elastic disc (123) is positioned between the smaller diameter end faces (121) of said segments (117) and said collar (119).

5. An anchor bolt, according to claim 4, characterized in that the elastic disc (123) has a square radially outer periphery.

6. An anchor bolt, according to any one of the claims 1, 2 or 3, characterized in that the segments (117) of the sleeve (112) have a radially inner periphery and a guide surface (126) projecting radially inwardly from the inner periphery.

7. An anchor bolt, according claim 6 characterized in that the segments (117) of the sleeve (112) are provided on at least one of the guide surfaces (126) with an axially extending, radially inwardly open, substantially semicircular groove (127), and in that the cone element (113) is provided with at least one projecting web (138) extending in the same direction and with the same shape.

8. An anchor bolt, according to any one of the claims 1, 2 or 3, characterized in that the cone element (113) is provided with a stop collar (134) at the larger diameter end thereof.

9. An anchor bolt, according to any one of the claims 1, 2 or 3, characterized in that the segments (117) of the sleeve (112) are pressed together by means of an external spring ring (129).

10. An anchor bolt, according to any one of the claims 2 or 3, characterized in that the axial stop 131 is ring-shaped and is attached rigidly to the tie rod (108) and the tie rod (108) is threaded at the end adjacent said axial stop and said cone element (113) is screwed onto the threaded end.

* * * * *